US007940233B2

(12) United States Patent
Kim et al.

(10) Patent No.: US 7,940,233 B2
(45) Date of Patent: May 10, 2011

(54) LIGHT EMITTING DISPLAY, DISPLAY PANEL, AND DRIVING METHOD THEREOF

(75) Inventors: Yang-Wan Kim, Youngin-si (KR); Choon-Yul Oh, Gunpo-si (KR); Kyoung-Do Kim, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1478 days.

(21) Appl. No.: 10/919,693

(22) Filed: Aug. 16, 2004

(65) Prior Publication Data

US 2005/0140600 A1 Jun. 30, 2005

(30) Foreign Application Priority Data

Nov. 27, 2003 (KR) ..... 10-2003-0085067

(51) Int. Cl.
*G09G 3/30* (2006.01)

(52) U.S. Cl. ..... 345/76; 345/690; 345/82

(58) Field of Classification Search ..... 345/76, 345/690; 315/169.1, 169.3
See application file for complete search history.

(56) References Cited

U.S. PATENT DOCUMENTS

| | | | | |
|---|---|---|---|---|
| 5,952,789 | A | 9/1999 | Stewart et al. | |
| 6,229,506 | B1 | 5/2001 | Dawson et al. | |
| 6,373,454 | B1 | 4/2002 | Knapp et al. | |
| 6,384,804 | B1 | 5/2002 | Dodabalapur et al. | |
| 6,433,488 | B1 * | 8/2002 | Bu | 315/169.3 |
| 6,577,302 | B2 | 6/2003 | Hunter et al. | |
| 6,847,171 | B2 * | 1/2005 | Tam | 315/169.3 |
| 6,858,992 | B2 | 2/2005 | Park et al. | |
| 6,970,149 | B2 * | 11/2005 | Chung et al. | 345/82 |
| 7,061,451 | B2 | 6/2006 | Kimura | |
| 2002/0021293 | A1 | 2/2002 | Tam | |
| 2002/0089357 | A1 | 7/2002 | Pae et al. | |
| 2003/0011584 | A1 | 1/2003 | Azami et al. | |

(Continued)

FOREIGN PATENT DOCUMENTS

CN 1361510 7/2002

(Continued)

OTHER PUBLICATIONS

Patent Abstracts of Japan, Publication No. 2003-122301, dated Apr. 25, 2003, in the name of Hajime Akimoto et al.

(Continued)

*Primary Examiner* — Quan-Zhen Wang
*Assistant Examiner* — Calvin C Ma
(74) *Attorney, Agent, or Firm* — Christie, Parker & Hale, LLP

(57) ABSTRACT

A light emitting display including data lines for transmitting data voltages, scan lines for selecting select signals, and pixel circuits. The pixel circuit is coupled to a data line and a scan line. The pixel circuit includes a transistor including first, second, and third electrodes, wherein the third electrode outputs a current corresponding to a voltage between the first and second electrodes. A light emitting element coupled to the third electrode emits light corresponding to the current outputted by the third electrode. A first switch transmits a data voltage in response to a select signal from the scan line. A voltage compensator receives the data voltage transmitted by the first switch and a second power supply voltage and applies a compensated data voltage based on the data voltage, a first power supply voltage and the second power supply voltage to the first electrode of the transistor.

26 Claims, 12 Drawing Sheets

U.S. PATENT DOCUMENTS

| | | | | |
|---|---|---|---|---|
| 2003/0016190 | A1 | 1/2003 | Kondo | |
| 2003/0020705 | A1 | 1/2003 | Kondo et al. | |
| 2003/0067424 | A1 | 4/2003 | Akimoto et al. | |
| 2003/0090446 | A1 | 5/2003 | Tagawa et al. | |
| 2003/0107536 | A1 | 6/2003 | Ishizuka et al. | |
| 2003/0112208 | A1 | 6/2003 | Okabe et al. | |
| 2003/0179164 | A1 | 9/2003 | Shin et al. | |
| 2003/0231152 | A1 | 12/2003 | Shin | |
| 2004/0026723 | A1 | 2/2004 | Miyazawa | |
| 2004/0041750 | A1 | 3/2004 | Abe | |
| 2004/0046164 | A1 | 3/2004 | Kobayashi et al. | |
| 2004/0051685 | A1 | 3/2004 | Chung et al. | |
| 2004/0070557 | A1 | 4/2004 | Asano et al. | |
| 2004/0090434 | A1 | 5/2004 | Miyazawa | |
| 2004/0095168 | A1 | 5/2004 | Miyazawa | |
| 2004/0095298 | A1 | 5/2004 | Miyazawa | |
| 2004/0095338 | A1 | 5/2004 | Miyazawa | |
| 2004/0174354 | A1 | 9/2004 | Ono et al. | |
| 2004/0222954 | A1* | 11/2004 | Lueder | 345/87 |

FOREIGN PATENT DOCUMENTS

| | | | |
|---|---|---|---|
| EP | 10220 191 | A2 | 7/2002 |
| EP | 10220 191 | A3 | 9/2003 |
| JP | 2003-122301 | | 4/2003 |
| JP | 2003-173165 | | 6/2003 |
| JP | 2003-186438 | | 7/2003 |
| JP | 2003-195809 | | 7/2003 |
| JP | 2003-223138 | | 8/2003 |
| JP | 2004-133240 | | 4/2004 |
| JP | 2004-286816 | | 10/2004 |
| KR | 10-0370286 | | 7/2002 |

OTHER PUBLICATIONS

Patent Abstracts of Japan, Publication No. 2003-195809, dated Jul. 9, 2003, in the name of Tomoyuki Maeda.

Patent Abstracts of Japan, Publication No. 2003-223138, dated Aug. 8, 2003, in the name of Hajime Kimura.

Patent Abstracts of Japan, Publication No. 2004-133240, dated Apr. 30, 2004, in the name of Shin Asano et al.

Patent Abstracts of Japan, Publication No. 2004-286816, dated Oct. 14, 2004, in the name of Yoshiaki Aoki.

Japanese Office action dated Jun. 16, 2009, for corresponding Japanese application 2004-051968, noting listed reference in this IDS, as well as JP 2003-173165 previously filed in an IDS dated Feb. 27, 2006 and JP 2005-157308 published subsequent to the filing of U.S. Appl. No. 10/919,693.

Patent Abstracts of Japan, Publication No. 2003-186438, dated Jul. 4, 2003, in the name of Yoshiaki Mikami et al.

Korean Patent Abstract, Publication No. 100370286, Published Jul. 7, 2002, in the name of O. Gyeong Kwon.

Patent Abstract of Japan, Publication No. 2003173165, Published Jun. 20, 2003, in the name of Aoki Yoshiaki.

European Search Report of EP 04 090 383.3, dated Nov. 30, 2005, corresponding to U.S. Appl. No. 10/963,389.

European Search Report of EP 04 090 384.1, dated Dec. 14, 2005, corresponding to U.S. Appl. No. 10/919,693.

Choi, S., et al., *An Improved Voltage Programmed Pixel Structure for Large Size and High Resolution AM-OLED Displays*, SID 04 Digest, 2004, pp. 260-263, XP-001222795.

* cited by examiner

LIGHT EMITTING DISPLAY, DISPLAY PANEL, AND DRIVING METHOD THEREOF

CROSS REFERENCE TO RELATED APPLICATION

This application claims priority to and the benefit of Korean Patent Application No. 2003-85067 filed on Nov. 27, 2003 in the Korean Intellectual Property Office, the entire content of which is incorporated herein by reference.

BACKGROUND OF THE INVENTION (a) Field of the Invention

The present invention relates to a light emitting display and a driving method thereof. More specifically, the present invention relates to an organic EL (electroluminescent) display.

(b) Description of the Related Art

In general, an organic EL display electrically excites a phosphorous organic compound to emit light, and it voltage- or current-drives N×M organic emitting cells to display images. As shown in FIG. 1, the organic emitting cell includes an anode (ITO), an organic thin film, and a cathode layer (metal). The organic thin film has a multi-layer structure including an EML (emitting layer), an ETL (electron transport layer), and an HTL (hole transport layer) for maintaining balance between electrons and holes and improving emitting efficiencies. The organic thin film further includes an EIL (electron injecting layer) and an HIL (hole injecting layer).

Methods for driving the organic emitting cells include a passive matrix method, and an active matrix method using TFTs (thin film transistors) or MOSFETs. In the passive matrix method, cathodes and anodes that cross over each other are formed and used to selectively drive lines. In the active matrix method, a TFT and a capacitor are connected with each ITO (indium tin oxide) pixel electrode to thereby maintain a predetermined voltage according to capacitance. The active matrix method is classified as either a voltage programming method or a current programming method based on signal forms supplied to maintain the voltage at the capacitor.

FIG. 2 shows a conventional voltage programming-type pixel circuit for driving an organic EL element (OLED), representing one of n×m pixels.

A transistor Ma coupled between the power supply voltage $V_{DD}$ and an OLED controls the current flowing to the OLED. A transistor Mb transmits a data line voltage to a gate of the transistor Ma in response to a select signal applied from a scan line $S_n$. A capacitor $C_{st}$ coupled between a source and the gate of the transistor Ma is charged with the data voltage and maintains the charged state for a predetermined time.

In detail, when the transistor Mb is turned on in response to a select signal applied to the gate of the switching transistor Mb, a data voltage from the data line $D_m$ is applied to the gate of the transistor Ma. Accordingly, the current $I_{OLED}$ corresponding to a voltage $V_{GS}$ charged by the capacitor $C_{st}$ between the gate and the source of the transistor Ma flows through the transistor Ma, and the OLED emits light corresponding to the current $I_{OLED}$.

By way of example, the current that flows to the OLED is given in Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{Equation 1}$$

where $I_{OLED}$ is the current flowing to the OLED, $V_{GS}$ is a voltage between the source and the gate of the transistor Ma, $V_{TH}$ is a threshold voltage at the transistor Ma, β is a constant, and $V_{DD}$ is a power supply voltage for a pixel.

As given in Equation 1, the current corresponding to the applied data voltage is supplied to the OLED, and the OLED gives light corresponding to the supplied current, according to the pixel circuit of FIG. 2. In this instance, the applied data voltage has multi-stage values within a predetermined range so as to represent gray.

However, when a voltage drop (IR-drop) is generated on a line for supplying the power supply voltage VDD, and the power supply voltage $V_{DD}$ applied to a plurality of pixel circuits is not uniform, a desired amount of current may not flow to the OLED, thereby degrading image qualities, since the current flowing to the OLED is influenced by the power supply voltage $V_{DD}$ in the conventional pixel circuit based on the voltage programming method. As the area of the organic EL display becomes larger, and the brightness increases, the voltage drop on the line for supplying the power supply voltage $V_{DD}$ increases to generate further problems.

SUMMARY OF THE INVENTION

In exemplary embodiments of the present invention, a current that flows to the OLED of a pixel circuit in a light emitting display is substantially prevented from being influenced by a power supply voltage.

Further, a current that flows to the OLED of a pixel circuit in a light emitting display may be substantially prevented from being influenced by deviations of a threshold voltage of a driving transistor.

In exemplary embodiments of the present invention, a light emitting display suitable for application as a large screen and high brightness display is provided.

In an exemplary embodiment of the present invention, a light emitting display includes a plurality of data lines for transmitting data voltages corresponding to video signals, a plurality of scan lines for transmitting select signals, and a plurality of pixel circuits. Each said pixel circuit is coupled to a corresponding said data line to receive a corresponding said data voltage and a corresponding said scan line to receive a corresponding said select signal. Each said pixel circuit includes a transistor including a first electrode, a second electrode for receiving a first power supply voltage, and a third electrode for outputting a current corresponding to a voltage between the first electrode and the second electrode. A light emitting element coupled to the third electrode emits light corresponding to the current outputted by the third electrode. A first switch transmits the corresponding said data voltage in response to the corresponding said select signal from the corresponding said scan line. A voltage compensator receives the corresponding said data voltage transmitted by the first switch and a second power supply voltage, and applies a compensated data voltage based on the corresponding said data voltage, the first power supply voltage and the second power supply voltage to the first electrode of the transistor.

In another exemplary embodiment of the present invention, a light emitting display includes a plurality of data lines for transmitting data voltages corresponding to video signals, a plurality of scan lines for selecting select signals, and a plurality of pixel circuits. Each said pixel circuit is coupled to a corresponding said data line to receive a corresponding said data voltage and a corresponding said scan line to receive a corresponding said select signal. Each said pixel circuit includes a transistor including a first electrode, a second electrode for receiving a first power supply voltage, and a third electrode for outputting a current corresponding to a voltage between the first electrode and the second electrode. A light emitting element coupled to the third electrode emits light corresponding to the current outputted by the third electrode. A first capacitor is coupled between the first and second electrodes of the transistor. A first switch transmits the corresponding said data voltage in response to the corresponding said select signal from the corresponding said scan line. A voltage compensator receives the corresponding said data voltage transmitted by the first switch and applies a compensated data voltage based on the corresponding said data voltage and the first power supply voltage to the first electrode of the transistor.

In still another exemplary embodiment of the present invention, a method for driving a display panel including a matrix of pixel circuits is provided. Each said pixel circuit includes a transistor including a first electrode, a second electrode for receiving a first power supply voltage, and a third electrode for outputting a current corresponding to a voltage between the first electrode and the second electrode. A light emitting element coupled to the third electrode emits light corresponding to the current outputted by the third electrode. A capacitor has a first electrode coupled to the first electrode of the transistor, and a switch is coupled between a second electrode of the capacitor and a scan line. The first power supply voltage is applied to the first electrode of the capacitor, and a data voltage is applied to the second electrode of the capacitor through the switch. The first electrode of the capacitor is substantially electrically isolated from the first power supply voltage, and a second power supply voltage is applied to the second electrode of the capacitor.

In still yet another exemplary embodiment of the present invention, a method for driving a display panel including a matrix of pixel circuits is provided. Each said pixel circuit includes a first transistor including a first electrode, a second electrode for receiving a first power supply voltage, and a third electrode for outputting a current corresponding to a voltage between the first electrode and the second electrode. A light emitting element coupled to the third electrode emits light corresponding to the current outputted by the third electrode. A capacitor has a first electrode coupled to the first electrode of the first transistor. A second transistor has a first electrode coupled to a second electrode of the capacitor, a second electrode, and a third electrode, and is diode-connected. A switch is coupled between the second electrode of the second transistor and a scan line. The first power supply voltage is applied to the first electrode of the capacitor, and a data voltage is applied to the second electrode of the second transistor through the switch. A second power supply voltage is applied to the second electrode of the capacitor.

In still yet another exemplary embodiment of the present invention, a method for driving a display panel including a matrix of pixel circuits is provided. Each said pixel circuit includes a transistor including a first electrode, a second electrode for receiving a first power supply voltage, and a third electrode for outputting a current corresponding to a voltage between the first electrode and the second electrode. A light emitting element coupled to the third electrode emits light corresponding to the current outputted by the third electrode. A capacitor has a first electrode coupled to the first electrode of the transistor. A switch is coupled between a second electrode of the capacitor and a scan line. The transistor is diode-connected, and a data voltage is applied to the second electrode of the capacitor. A second power supply voltage is applied to the second electrode of the capacitor.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various different ways, all without departing from the spirit or the scope of the invention. Accordingly, the drawings and description are to be regarded as illustrative in nature, and not restrictive.

Figure 1:
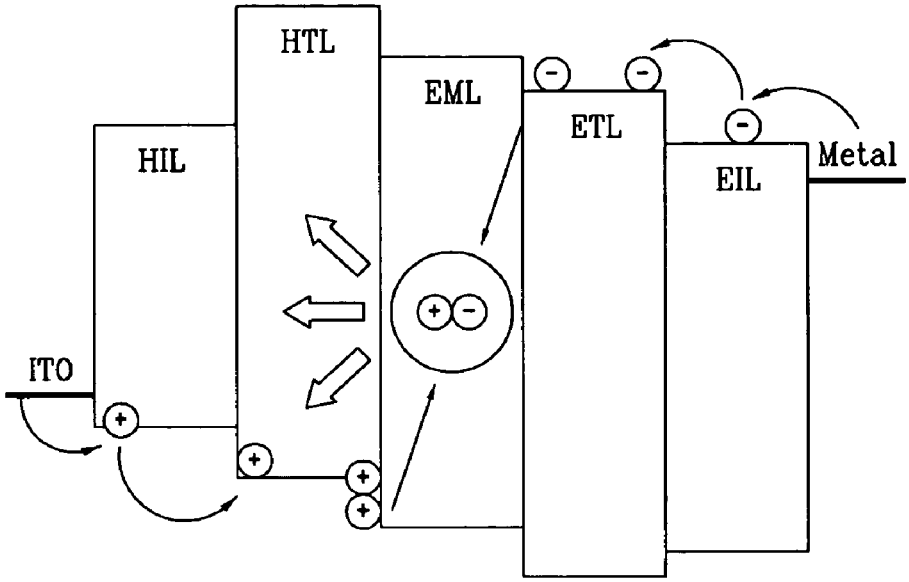
FIG. 1 shows a conceptual diagram of an OLED.
Figure 2:
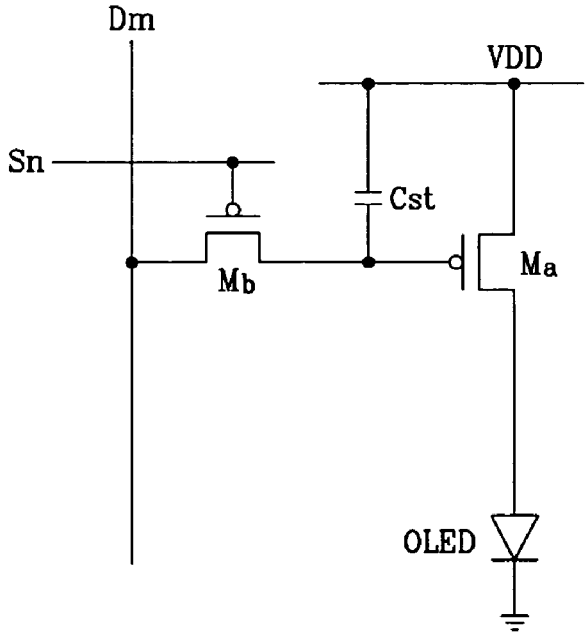
FIG. 2 shows an equivalent circuit diagram of a conventional pixel circuit used with the voltage programming method.
Figure 3:
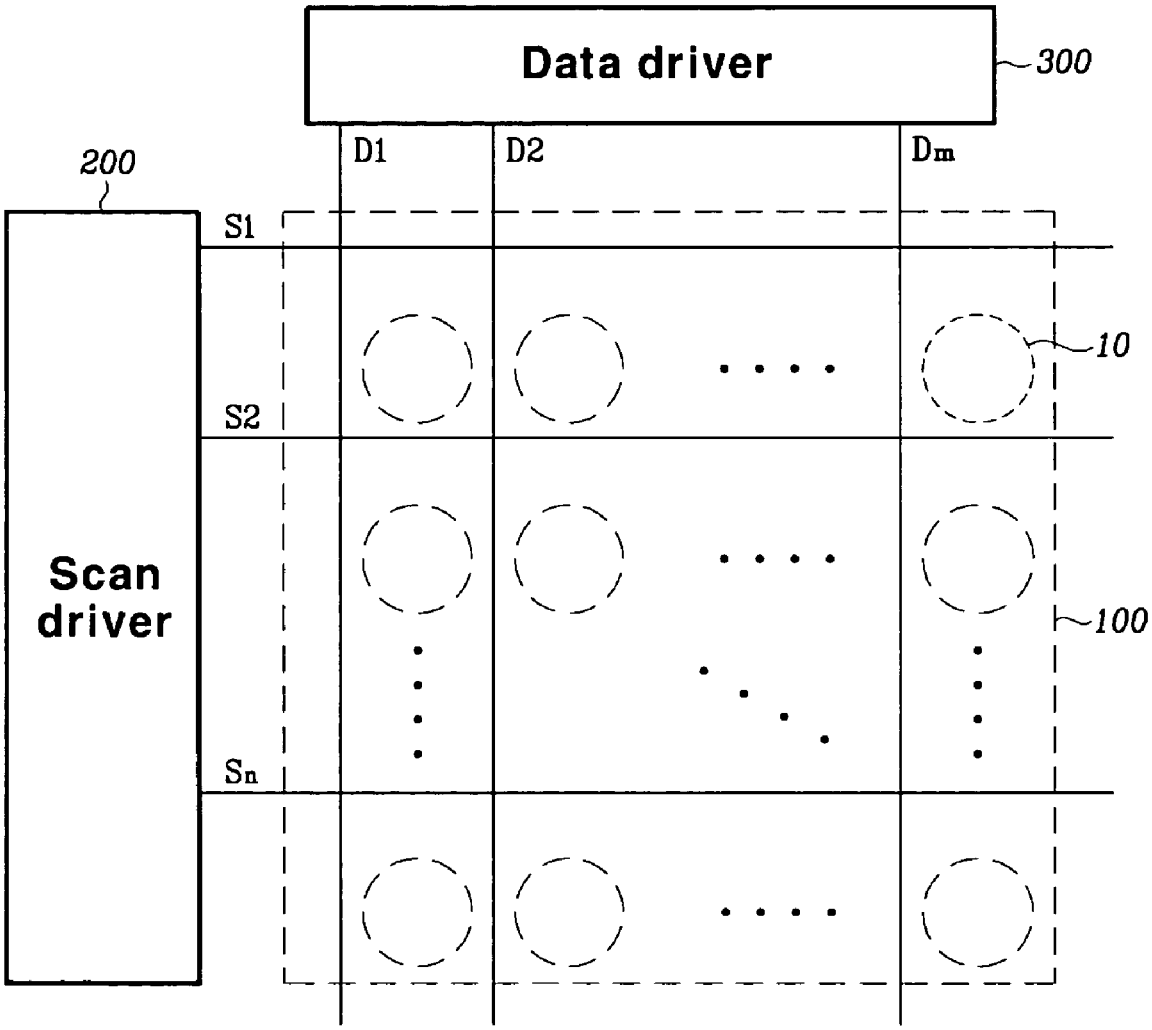
FIG. 3 shows an organic EL display in an exemplary embodiment of the present invention.

FIG. 3 shows an organic EL display according to an exemplary embodiment of the present invention.

As shown, the organic EL display includes an organic EL display panel 100, a scan driver 200, and a data driver 300.

The organic EL display panel 100 includes a plurality of data lines $D_1$ through $D_m$, each extending in a column direction, a plurality of scan lines $S_1$ through $S_n$, each extending in a row direction, and a plurality of pixel circuits 10. The data lines $D_1$ through $D_m$ transmit data voltages that correspond to video signals to the pixel circuits 10, and the scan lines $S_1$ through $S_n$ transmit select signals for selecting the pixel circuits 10. Each pixel circuit 10 is formed at a pixel region defined by two adjacent data lines $D_1$ through $D_m$, and two adjacent scan lines $S_1$ through $S_n$.

The scan driver 200 sequentially applies select signals to the scan lines $S_1$ through $S_n$, and the data driver 300 applies the data voltage that corresponds to video signals to the data lines $D_1$ through $D_m$.

The scan driver 200 and/or the data driver 300 may be coupled to the display panel 100, or may be installed, in a chip format, in a TCP (tape carrier package) coupled to the display panel 100. The same can be attached to the display panel 100, and installed, in a chip format, on an FPC (flexible printed circuit) or a film coupled to the display panel 100, which is referred to as a CoF (chip on flexible board, or chip on film) method. In other embodiments, the scan driver 200 and/or the data driver 300 may be installed on a glass substrate of the display panel. Further, the same can be substituted for the driving circuit formed in the same layers as the scan lines, the data lines, and TFTs on the glass substrate, or directly installed on the glass substrate.

Referring to FIGS. 4 through 6A, a pixel circuit that can be used as the pixel circuit 10 of the organic EL display 100 will be described.

Figure 4:
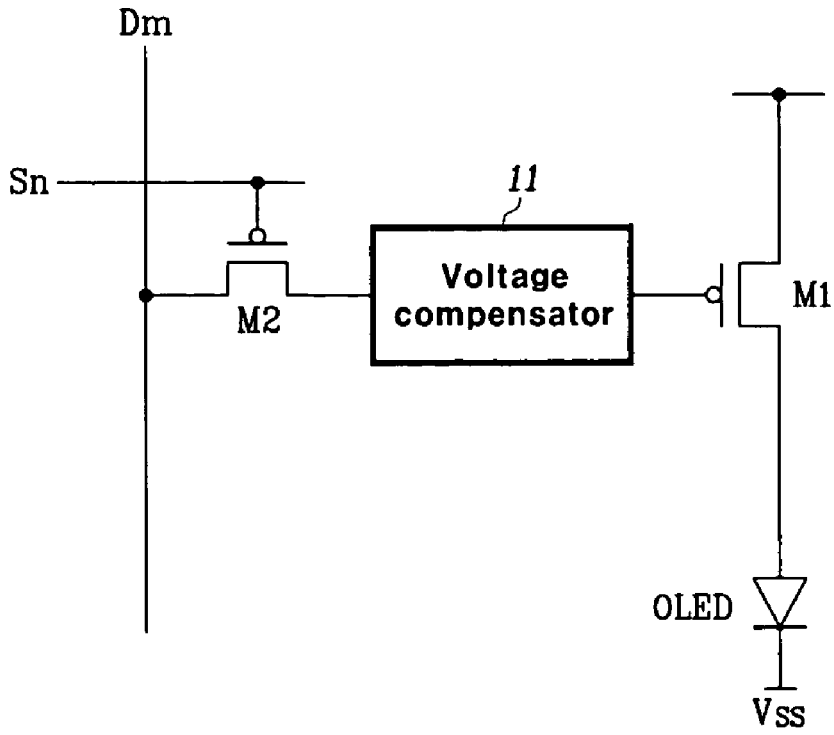
FIG. 4 shows a brief diagram of a pixel circuit according to a first exemplary embodiment of the present invention.

FIG. 4 shows a brief diagram of the pixel circuit. For ease of description, the pixel circuit coupled to the m-th data line Dm and the n-th scan line Sn will be described.

As shown, the pixel circuit according to the first exemplary embodiment of the present invention includes an organic EL element (OLED), transistors M1 and M2, and a voltage compensator 11. In the described embodiment, the transistors M1 and M2 are P-type transistors having a P-type channel.

The transistor M1 is a driving transistor for controlling the current that flows to the OLED, and it has a source coupled to the power supply voltage $V_{DD}$, and a drain coupled to an anode of the OLED. A cathode of the OLED is coupled to a reference voltage $V_{SS}$ and emits light that corresponds to the current applied from the transistor M1. The reference voltage $V_{SS}$ is a voltage lower than the power supply voltage $V_{DD}$. By way of example, the ground voltage can be used as the reference voltage $V_{SS}$.

The transistor M2 transmits a data voltage applied to the data line $D_m$ to the voltage compensator 11 in response to a select signal from the scan line $S_n$.

The voltage compensator 11 is coupled between a gate of the transistor M1 and a drain of the transistor M2, receives the data voltage transmitted by the transistor M2 and applies a compensated data voltage based on the data voltage and the power supply voltage $V_{DD}$ to the gate of the transistor M1.

Figure 5:
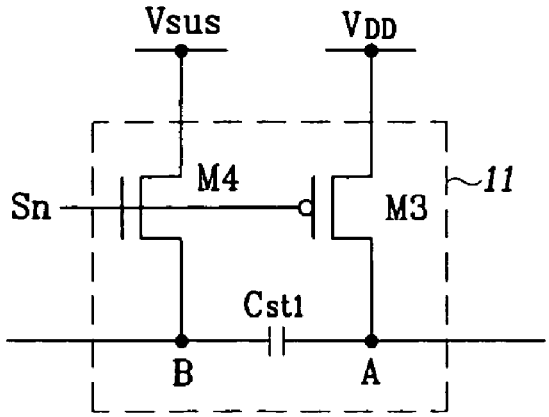
FIG. 5 shows an internal circuit of a voltage compensator shown in FIG. 4.

FIG. 5 shows an internal circuit for the voltage compensator 11 of FIG. 4.

As shown, the voltage compensator 11 includes transistors M3 and M4, and a capacitor $C_{st1}$. It can be seen in FIG. 5 that the transistor M3 is a P-type transistor, while the transistor M4 is an N-type transistor having an N-type channel. In other embodiments, the transistors may have different channel types.

A first electrode A of the capacitor $C_{st1}$ is coupled to the gate of the transistor M1, and a second electrode B thereof is coupled to the drain of the transistor M2.

The transistor M3 is coupled between the power supply voltage $V_{DD}$ and the first electrode A of the capacitor $C_{st1}$, and applies the power supply voltage $V_{DD}$ to the first electrode A of the capacitor $C_{st1}$ in response to the select signal from the scan line $S_n$.

The transistor M4 is coupled between a compensation voltage $V_{sus}$ and the second electrode B of the capacitor $C_{st1}$, and applies the compensation voltage $V_{sus}$ to the second electrode B of the capacitor $C_{st1}$ in response to the select signal of the scan line $S_n$.

The select signal from the scan line $S_n$ is applied to the gates of the transistors M3 and M4 in FIG. 5. A control signal other than the select signal may be applied to at least one of the transistors M3 and M4. In such cases, the transistors M3 and M4 may have the same type of channel.

Figure 6A:
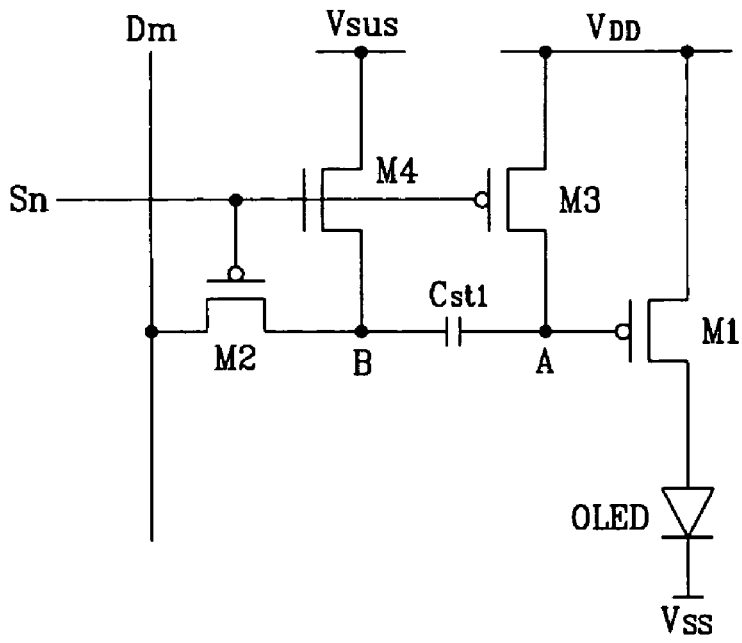
FIG. 6A shows an application of the voltage compensator circuit of FIG. 5 to the pixel circuit of FIG. 4.

FIG. 6A shows an application of the voltage compensator 11 of FIG. 5 to the pixel circuit of FIG. 4.

Operation of the pixel circuit according to the first exemplary embodiment will be described with reference to FIG. 6A.

When the select signal from the scan line $S_n$ becomes low level, the transistor M2 is turned on and the data voltage is applied to the second electrode B of the capacitor $C_{st1}$. Further, the transistor M3 is turned on and the power supply voltage $V_{DD}$ is applied to the first electrode A of the capacitor $C_{st1}$. Here, no current flows to the OLED since the power supply voltage $V_{DD}$ is applied to the gate and the source of the transistor M1. With the low level select signal from the present scan line $S_n$, the transistor M4 is turned off, thereby substantially electrically isolating the compensation voltage $V_{sus}$ from the second electrode B of the capacitor $C_{st1}$.

When the select signal from the scan line $S_n$ becomes high level, the transistor M4 is turned on and the compensation voltage $V_{sus}$ is applied to the second electrode B of the capacitor $C_{st1}$.

Therefore, the voltage applied to the second electrode B of the capacitor $C_{st1}$ is changed to the compensation voltage $V_{sus}$ from the data voltage. In this instance, the charges charged in the capacitor $C_{st1}$ is substantially constantly maintained since no current path is formed in the pixel circuit. That is, the voltage $V_{AB}$ between the electrodes of the capacitor $C_{st1}$ is to be maintained substantially constantly, and the voltage at the first electrode A of the capacitor $C_{st}$ is varied by a voltage variation $\Delta V_B$ of the second electrode B thereof. A voltage $V_A$ of the first electrode A of the capacitor $C_{st1}$ is given in Equation 2.

$$V_A = V_{DD} + \Delta V_B \qquad \text{Equation 2}$$

where $\Delta V_B$ is a voltage variation of the second electrode B of the capacitor $C_{st1}$ and is given in Equation 3.

$$\Delta V_B = V_{sus} - V_{DATA} \qquad \text{Equation 3}$$

In this instance, the current flows to the OLED through the transistor M1, and the current is given as Equation 4.

$$\begin{aligned} I_{OLED} &= \frac{\beta}{2}(V_{GS1} - V_{TH1})^2 \\ &= \frac{\beta}{2}((V_{DD} + \Delta V_B) - V_{DD} - V_{TH1})^2 \\ &= \frac{\beta}{2}(\Delta V_B - V_{TH1})^2 \end{aligned} \qquad \text{Equation 4}$$

-continued $$= \frac{\beta}{2}(V_{sus} - V_{DATA} - V_{TH1})^2$$

where $V_{GS1}$ is a voltage between the gate and the source of the transistor M1, and $V_{TH1}$ is a threshold voltage of the transistor M1.

As can be seen from Equation 4, the current flowing to the OLED is substantially not influenced by the power supply voltage $V_{DD}$. Also, substantially no voltage drop is generated since the compensation voltage $V_{sus}$ forms no current path, differing from the power supply voltage $V_{DD}$. Hence, the substantially the same compensation voltage $V_{sus}$ is applied to all the pixel circuits, and the current that corresponds to the data voltage flows to the OLED.

Also, since the transistor M1 has a P-type channel, the voltage $V_{GS}$ between the gate and the source of the transistor M1 is to be less than the threshold voltage $V_{TH1}$ in order to turn on the transistor M1. Therefore, the voltage obtained by subtracting the data voltage $V_{DATA}$ from the compensation voltage $V_{sus}$ is to be less than the threshold voltage of the transistor M1.

Figure 6B:
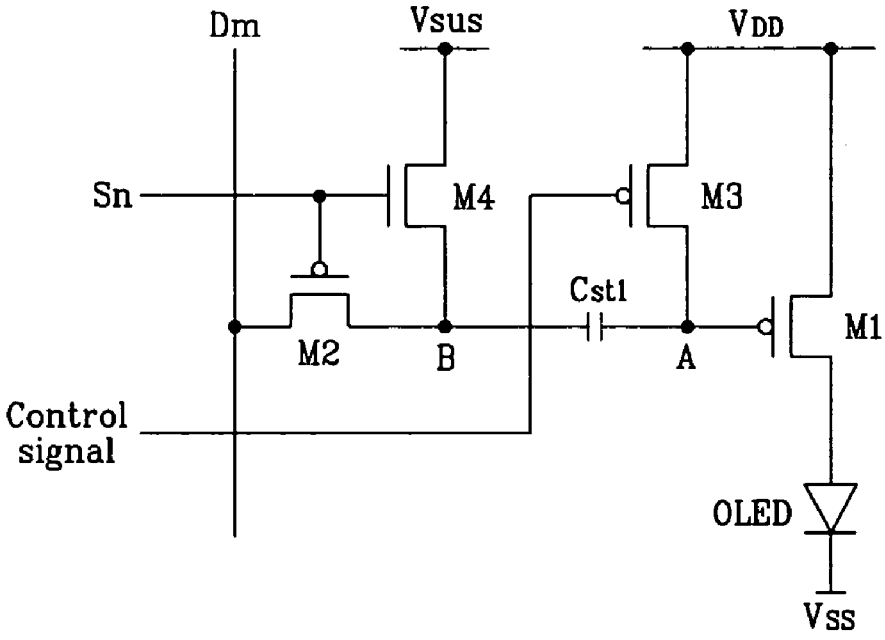
FIG. 6B shows a pixel circuit similar to the pixel circuit of FIG. 6A, in which an additional control signal is provided.
Figure 6C:
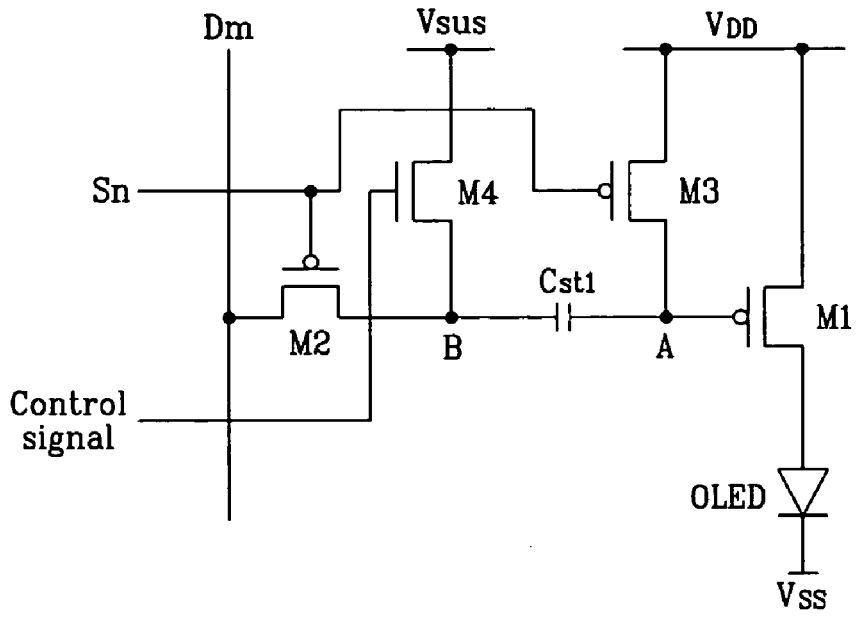
FIG. 6C shows a pixel circuit similar to the pixel circuit of FIG. 6A, in which an additional control signal is provided.

While the select signal from the scan line $S_n$ is applied to the gates of both the transistors M3 and M4 in FIG. 6A, an additional control signal having substantially the same characteristics as the select signal from the scan line $S_n$ may be applied to the gate of either the transistor M3 or the transistor M4. For example, FIG. 6B shows that an additional control signal is applied to the gate of the transistor M3. In addition, FIG. 6C shows that an additional control signal is applied to the gate of the transistor M4.

Figure 7A:
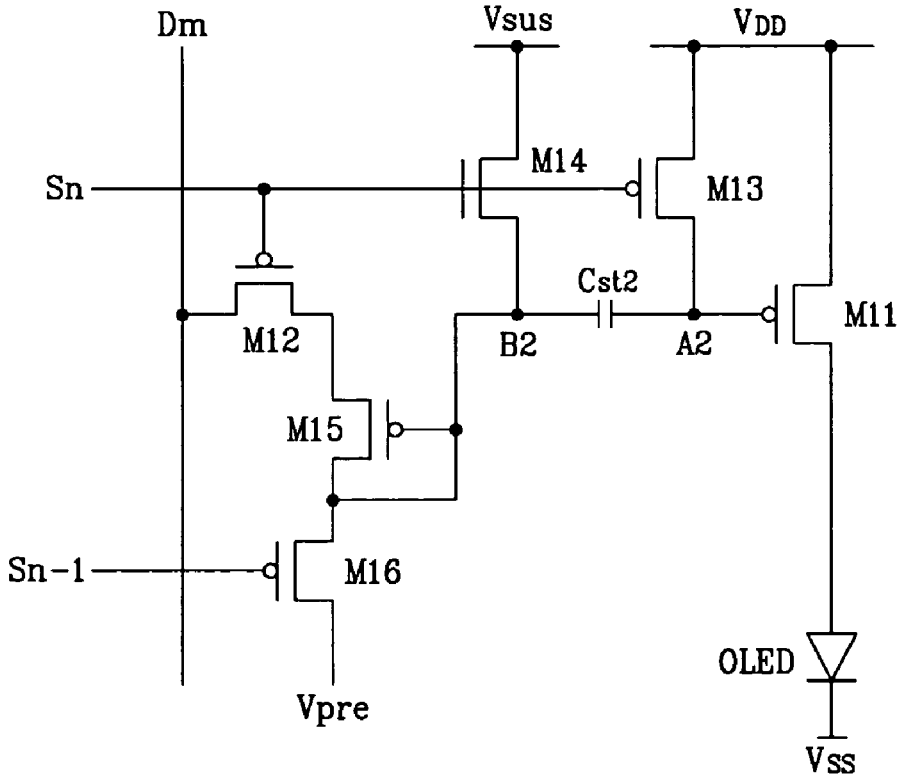
FIG. 7A shows a pixel circuit according to a second exemplary embodiment of the present invention.
Figure 8:
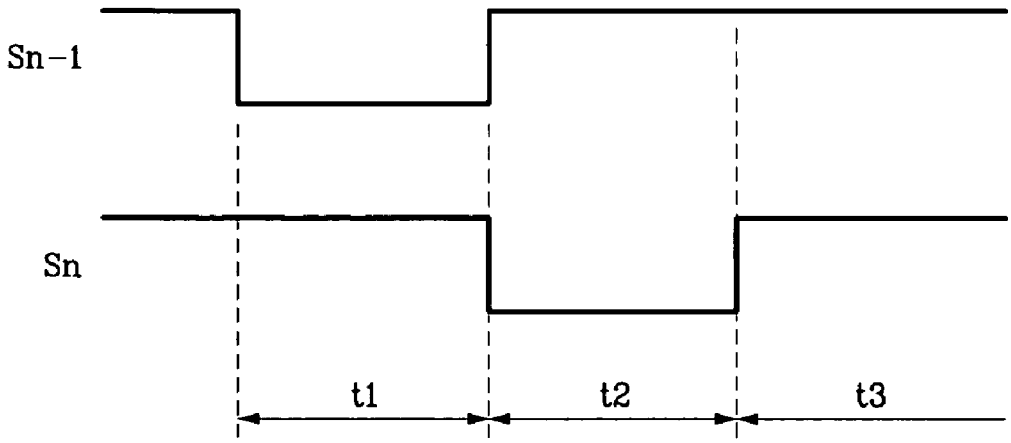
FIG. 8 shows a waveform diagram of a select signal applied to the pixel circuits of FIGS. 7A, 7B, 7C and 7D.

Referring to FIGS. 7A and 8, a pixel circuit according to a second exemplary embodiment of the present invention will be described. As to definition of scan lines, a "present scan line" represents a scan line for transmitting a present select signal, and a "previous scan line" indicates a scan line that has transmitted a select signal before the present select signal is transmitted.

FIG. 7A shows a pixel circuit according to a second exemplary embodiment of the present invention, and FIG. 8 shows a waveform diagram of a select signal applied to FIG. 7A.

In the pixel circuit of FIG. 7A, transistors M11, M12, M13, M14 and a capacitor $C_{st2}$ are connected together in substantially the same relationship as the M1, M2, M3, M4 and the capacitor $C_{st1}$ of FIG. 6A, except for the connection between the transistor M12, the transistor M14 and the capacitor $C_{st2}$. The capacitor $C_{st2}$ has electrodes A2 and B2 similar to the electrodes A and B of the capacitor $C_{st1}$. This pixel circuit according to the second exemplary embodiment is different from the pixel circuit of FIG. 6A in that the pixel circuit of FIG. 7A further includes a compensation transistor M15, which is diode-connected for compensating the threshold voltage of the driving transistor M11, and a transistor M16 for applying a pre-charge voltage $V_{pre}$ so that the compensation transistor M15 may be forward biased.

The drain of the transistor M12 is coupled to a source of the diode-connected compensation transistor M15. The transistor M16 is coupled between a drain of the diode-connected compensation transistor M15 and the pre-charge voltage $V_{pre}$. A previous scan line $S_{n-1}$ is coupled to a gate of the transistor M16.

An operation of the pixel circuit according to the second exemplary embodiment of the present invention will be described with reference to FIG. 8.

When a select signal from the previous scan line $S_{n-1}$ becomes low level during the pre-charge period t1, the transistor M16 is turned on, and the pre-charge voltage $V_{pre}$ is transmitted to the drain of the transistor M15. In this instance, it is desirable for the pre-charge voltage $V_{pre}$ to be a little less than the voltage applied to the gate of the transistor M15, that is, the lowest data voltage applied through the data line $D_m$, so that the pre-charge voltage $V_{pre}$ may reach the maximum gray level. Accordingly, when the data voltage is applied through the data line Dm, the data voltage becomes greater than the voltage applied to the gate of the transistor M15, and the transistor M15 is coupled forward.

Next, the select signal from the present scan line $S_n$ becomes low level and the transistor M12 is turned on during the data charging period t2, and hence, the data voltage is applied to the source of the transistor M15 through the transistor M12. In this instance, since the transistor M15 is diode-connected, a voltage that corresponds to a difference between the data voltage and a threshold voltage $V_{TH15}$ of the transistor M15 is applied to the second electrode B2 of the capacitor $C_{st2}$. Further, the transistor M13 is turned on and the power supply voltage $V_{DD}$ is applied to the first electrode A2 of the capacitor $C_{st2}$.

No current flows to the OLED since the voltage applied to the source and the gate of the transistor M11 corresponds to the power supply voltage $V_{DD}$ during the data charging period t2.

With the low level select signal from the present scan line $S_n$, the transistor M14 is turned off, thereby substantially electrically isolating the compensation voltage $V_{sus}$ from the second electrode B2 of the capacitor $C_{st2}$. The select signal from the present scan line $S_n$ becomes high level and the transistor M14 is turned on during the light emitting period t3. The compensation voltage $V_{sus}$ is applied to the second electrode B2 of the capacitor $C_{st2}$ through the transistor M14, and the voltage of the second electrode B2 of the capacitor $C_{st2}$ is changed to the compensation voltage $V_{sus}$. In this instance, since the voltage $V_{AB2}$ between the electrodes of the capacitor $C_{st2}$ is to be substantially constantly maintained, the voltage of the first electrode A2 of the capacitor $C_{st2}$ is varied by the voltage variation of the second electrode B2. The voltage $V_{A2}$ is given in Equation 5 below.

$$V_{A2}=V_{DD}+\Delta V_{B2}=V_{DD}+(V_{sus}-(V_{DATA}-V_{TH15}))=V_{DD}+V_{sus}-V_{DATA}+V_{TH15} \quad \text{Equation 5}$$

where $\Delta V_{B2}$ is a voltage variation of the second electrode B2 of the capacitor $C_{st2}$.

In this instance, the driving transistor M11 is turned on, and the current flows to the OLED. The current flowing to the OLED is given as Equation 6.

$$\begin{aligned} I_{OLED} &= \frac{\beta}{2}(V_{GS11} - V_{TH11})^2 \\ &= \frac{\beta}{2}((V_{DD} + V_{sus} - V_{DATA} + V_{TH15}) \\ &\quad - V_{DD} - V_{TH11})^2 \end{aligned} \quad \text{Equation 6}$$

When the threshold voltage of the transistor M11 substantially corresponds to that of the transistor M15, the current flowing to the OLED is given as Equation 7.

$$I_{OLED} = \frac{\beta}{2}(V_{sus} - V_{DATA})^2 \quad \text{Equation 7}$$

Therefore, the current that corresponds to the data voltage applied to the data line $D_m$ flows to the OLED irrespective of the power supply voltage $V_{DD}$ and the threshold voltage $V_{TH11}$ of the transistor M11.

Also, since the compensation voltage $V_{sus}$ forms no current path, a substantially uniform compensation voltage $V_{sus}$ is applied to all the pixel circuits, thereby enabling more fine gray representation.

As shown in FIG. 7A, the previous scan line $S_{n-1}$ is used to control the transistor M16 in the second exemplary embodiment. Alternatively, an additional control line (not illustrated) for transmitting a control signal for turning on the transistor M16 during the pre-charge period t1 may be used.

Figure 7B:
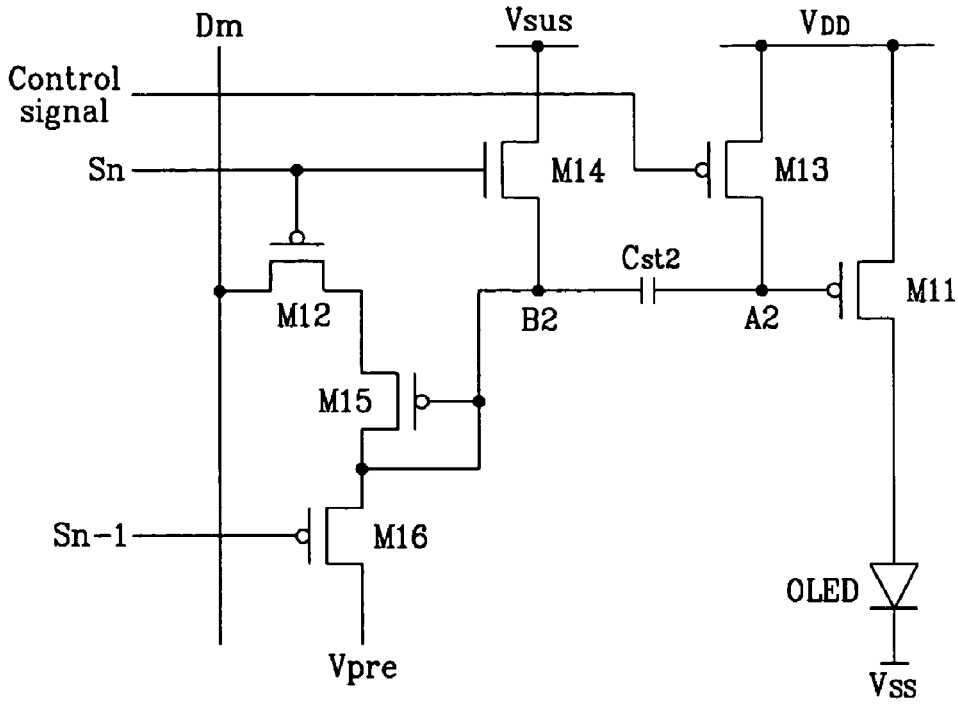
FIG. 7B shows a pixel circuit similar to the pixel circuit of FIG. 7A, in which an additional control signal is provided.
Figure 7C:
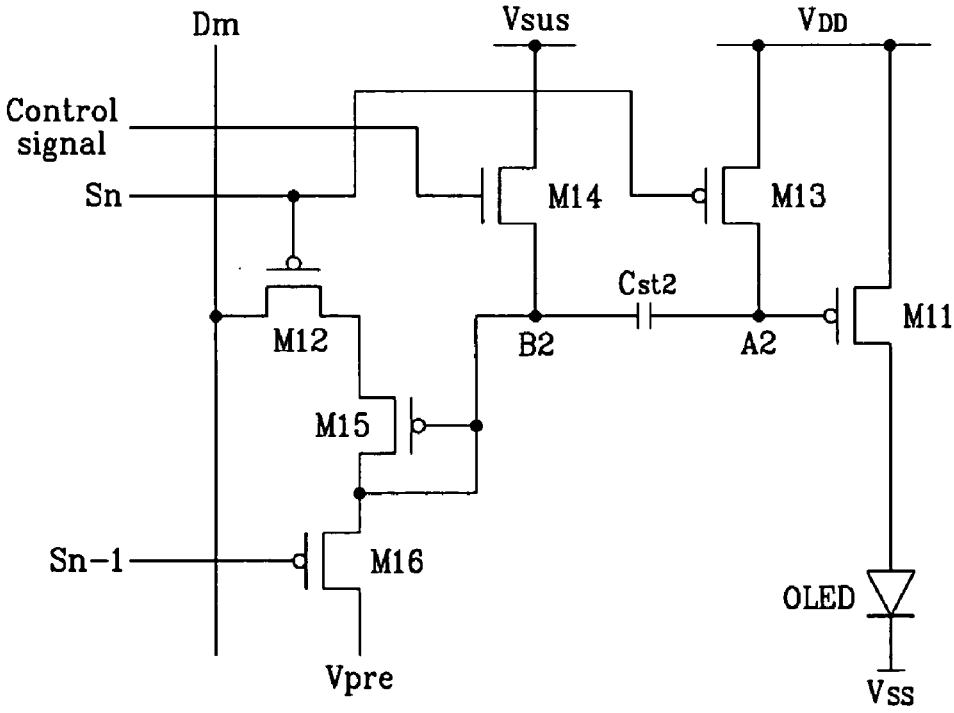
FIG. 7C shows a pixel circuit similar to the pixel circuit of FIG. 7A, in which an additional control signal is provided.

Further, while the select signal from the scan line $S_n$ is applied to the gates of both the transistors M13 and M14 in FIG. 7A, an additional control signal having substantially the same characteristics as the select signal from the scan line $S_n$ may be applied to the gate of either the transistor M13 or the transistor M14. For example, FIG. 7B shows that an additional control signal is applied to the gate of the transistor M13. In addition, FIG. 7C shows that an additional control signal is applied to the gate of the transistor M14.

Figure 7D:
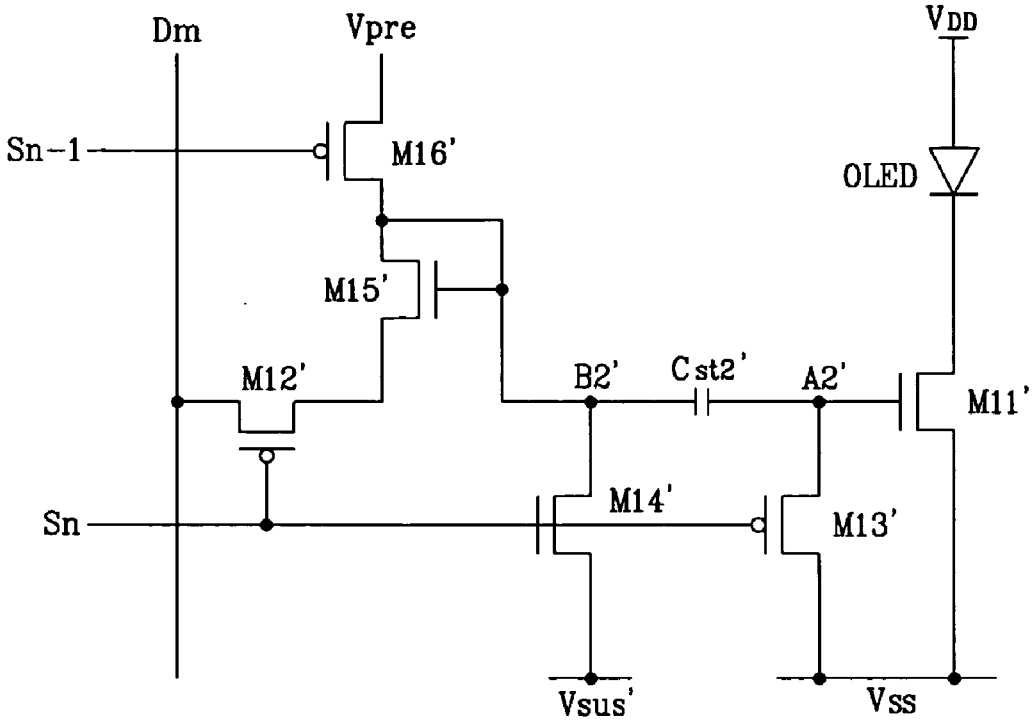
FIG. 7D shows a pixel circuit similar to the pixel circuit of FIG. 7A, in which a diode-connected transistor and a driving transistor have channel type different from that of the pixel circuit of FIG. 7A.

FIG. 7D illustrates a pixel circuit including transistors M11', M12', M13', M14', M15', M16' and a capacitor $C_{st2}'$ having electrodes A2' and B2', that are connected together in substantially the same relationship as the transistors M11, M12, M13, M14, M15, M16 and the capacitor $C_{st2}$ of FIG. 7A. However, the transistors M11' and M15' have an N-type channel, unlike the transistors M11 and M15 which have a P-type channel. The light emitting element OLED and the transistor M11' are connected in series between the power supply voltage VDD and the reference voltage Vss. The transistor M13' is connected between the electrode A2' and the reference voltage Vss, and the transistor M14' is connected between the electrode B2' and a compensation voltage $V_{sus}'$. A drain of the transistor M15' is connected to the transistor M12', and a gate and a source of the transistor M15' are connected together and also to the transistor M16'. Other than the fact that voltage levels applied to some of the transistors may be different, the pixel circuit of FIG. 7D operates in substantially the same manner as the pixel circuit of FIG. 7A.

Figure 9A:
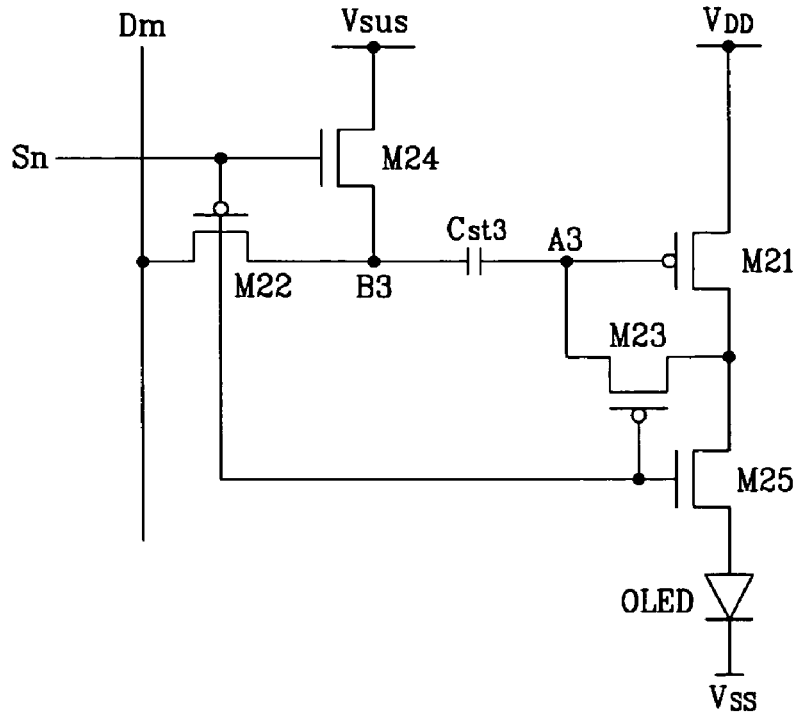
FIG. 9A shows a pixel circuit according to a third exemplary embodiment of the present invention.

FIG. 9A shows a pixel circuit according to a third exemplary embodiment of the present invention.

In the pixel circuit of FIG. 9A, transistors M21, M22, M24 and a capacitor $C_{st3}$ are connected together in substantially the same relationship as the transistors M11, M12, M14 and the capacitor $C_{st2}$ of FIG. 7A, except that a drain of the transistor M22 is connected to a second electrode B3 of the capacitor $C_{st3}$. The capacitor $C_{st3}$ has electrodes A3 and B3 similar to the electrodes A2 and B2 of the capacitor $C_{st2}$. The pixel circuit according to the third exemplary embodiment in FIG. 9A is different from the pixel circuit of FIG. 7A because in the pixel circuit of FIG. 9A, a source of a transistor M23 is coupled to a drain of the transistor M21, and the pixel circuit of FIG. 9A further includes a transistor M25 connected between the transistor M21 and the OLED. In the pixel circuit illustrated in FIG. 9A, the transistor M23 is P-type, while the transistor M25 is N-type. Gates of the transistors M23 and M25 are coupled to the present scan line $S_n$.

An operation of the pixel circuit according to the third exemplary embodiment will now be described with reference to FIG. 9A.

When a low-level select signal from the scan line $S_n$ is applied, the transistor M22 is turned on, and the data voltage from the data line $D_m$ is applied to the second electrode B3 of the capacitor $C_{st3}$. Further, the transistor M23 is turned on and the driving transistor M21 is diode-connected. Therefore, the threshold voltage $V_{TH21}$ of the driving transistor M21 is applied between a gate and a source of the driving transistor M21. In this instance, since the source of the driving transistor M21 is coupled to the power supply voltage $V_{DD}$, the voltage $V_{A3}$ applied to the first electrode A3 of the capacitor $C_{st3}$ is given as Equation 8.

$$V_{A3}=V_{DD}+V_{TH21} \quad \text{Equation 8}$$

With the low level select signal from the scan line $S_n$, the transistor M24 is turned off, thereby substantially electrically isolating the compensation voltage $V_{sus}$ from the second electrode B3 of the capacitor $C_{st3}$. Further, the transistor M25 is turned off, thereby substantially electrically isolating the drain of the transistor M21 from the OLED.

When the select signal from the scan line $S_n$ becomes high level, the transistor M24 is turned on to apply the compensation voltage $V_{sus}$ to the second electrode B3 of the capacitor $C_{st3}$. In this instance, since no current path is formed in the pixel circuit, the voltage of both electrodes of the capacitor $C_{st3}$ is to be substantially constantly maintained. Therefore, the voltage applied to the first electrode A3 of the capacitor $C_{st3}$ is varied by a voltage variation of the second electrode B3. Hence, the voltage at the first electrode A3 is given in Equation 9.

$$V_{A3}=V_{DD}+V_{TH21}+\Delta V_{B3} \quad \text{Equation 9}$$

where $\Delta V_{B3}$ is a voltage variation of the second electrode B3 of the capacitor $C_{st3}$ and is obtained by subtracting the data voltage from the compensation voltage $V_{sus}$.

Further, the transistor M25 is turned on, the current of the transistor M21 is transmitted to the OLED, and the OLED emits light in response to the applied current. By way of example, the current $I_{OLED}$ flowing to the OLED is given as Equation 10.

$$\begin{aligned} I_{OLED} &= \frac{\beta}{2}(V_{GS21}-V_{TH21})^2 \\ &= \frac{\beta}{2}((V_{DD}+V_{TH21}+\Delta V_{B3})-V_{DD}-V_{TH21})^2 \\ &\quad \frac{\beta}{2}(\Delta V_{B3})^2 \end{aligned} \quad \text{Equation 10}$$

Therefore, the current flowing to the OLED is substantially not influenced by a deviation between the power supply voltage $V_{DD}$ and the threshold voltage $V_{TH21}$ of the driving transistor M21.

Figure 9B:
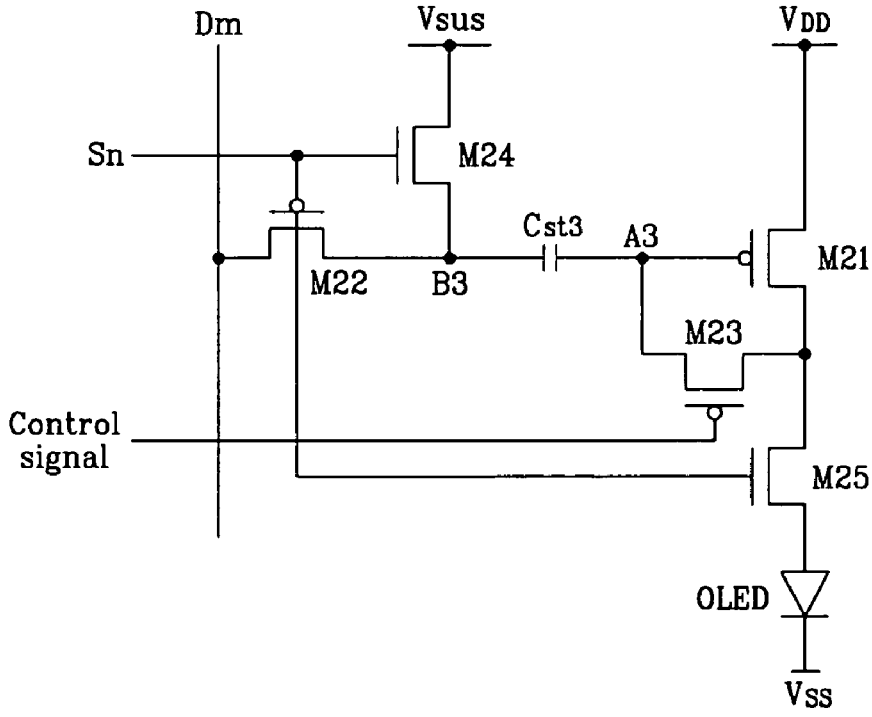
FIG. 9B shows a pixel circuit similar to the pixel circuit of FIG. 9A, in which an additional control signal is provided.
Figure 9C:
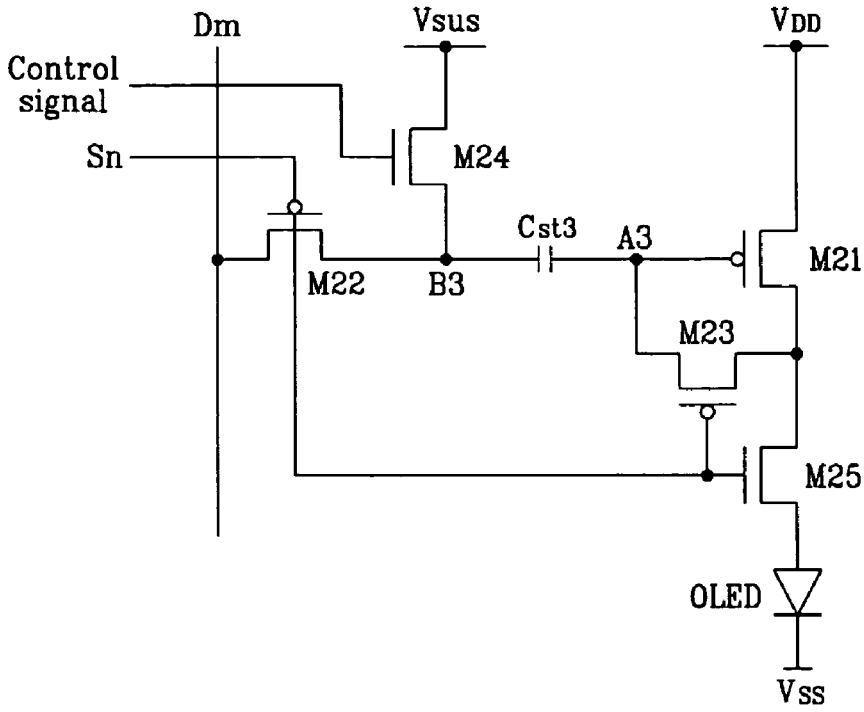
FIG. 9C shows a pixel circuit similar to the pixel circuit of FIG. 9A, in which an additional control signal is provided.
Figure 9D:
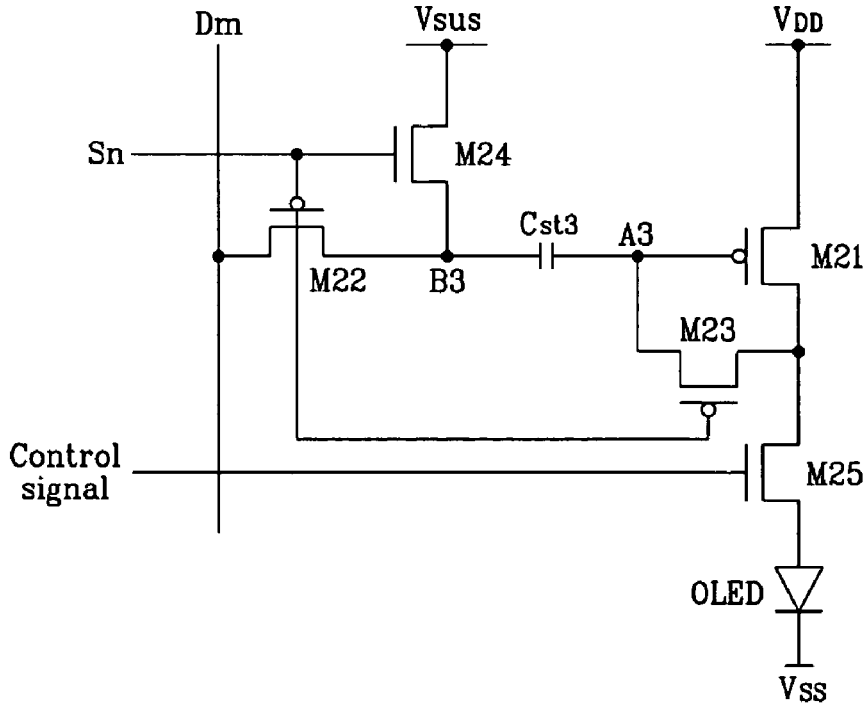
FIG. 9D shows a pixel circuit similar to the pixel circuit of FIG. 9A, in which an additional control signal is provided.

While the select signal from the scan line $S_n$ is applied to the gates of the transistors M23, M24 and M25 in FIG. 9A, an additional control signal having substantially the same characteristics as the select signal from the scan line $S_n$ may be applied to the gate of any of the transistors M23, M24 and M25. For example, FIG. 9B shows that an additional control signal is applied to the gate of the transistor M23. In addition, FIG. 9C shows that an additional control signal is applied to the gate of the transistor M24. Further, FIG. 9D shows that an additional control signal is applied to the gate of the transistor M25.

Figure 10:
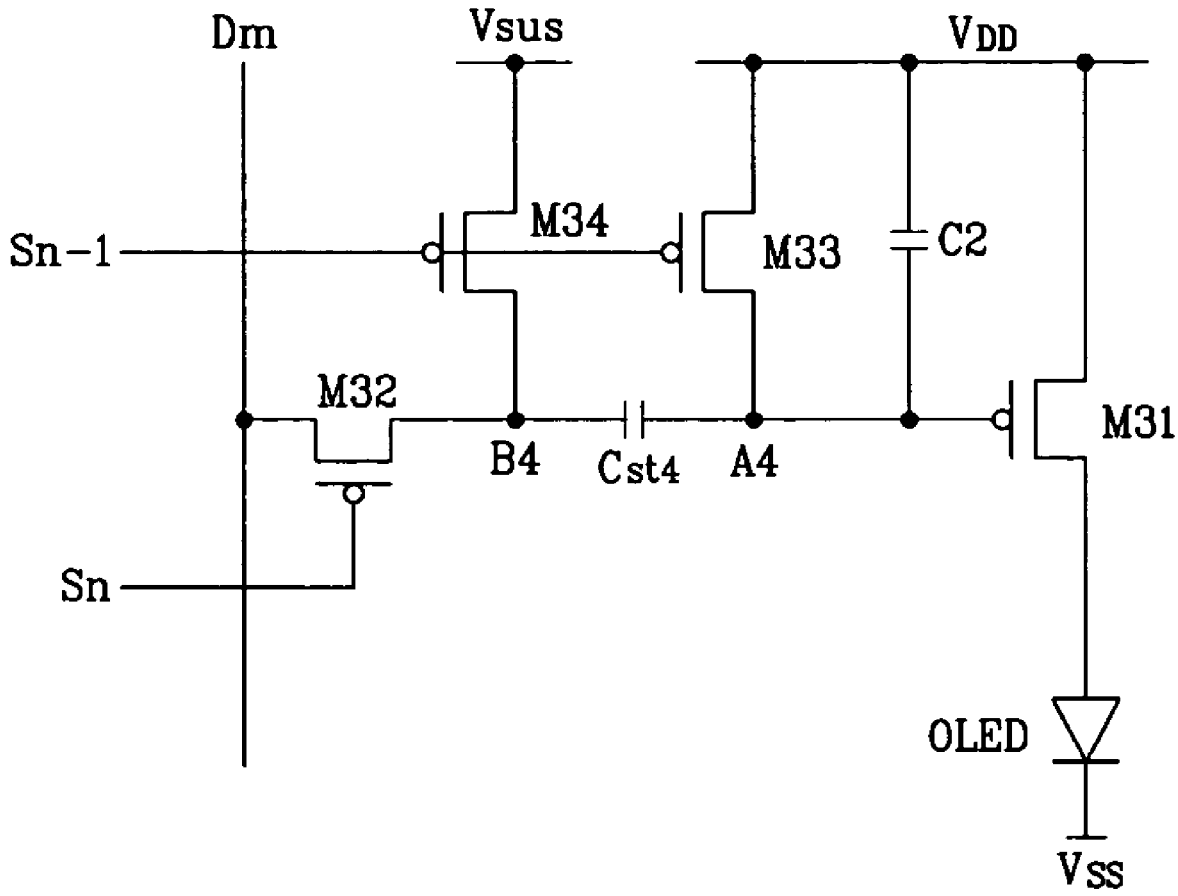
FIG. 10 shows a pixel circuit according to a fourth exemplary embodiment of the present invention.

FIG. 10 shows a pixel circuit according to a fourth exemplary embodiment of the present invention.

In the pixel circuit of FIG. 10, transistors M31, M32 and a capacitor $C_{st4}$ are connected together in substantially the same relationship as the transistors M1, M2 and the capacitor $C_{st1}$ of FIG. 6A. The capacitor $C_{st4}$ has electrodes A4 and B4 similar to the electrodes A and B of the capacitor $C_{st1}$. As shown, the pixel circuit according to the fourth exemplary embodiment is different from that of the first exemplary embodiment, as the pixel circuit according to the fourth exemplary embodiment further includes a capacitor C2 coupled between the power supply voltage $V_{DD}$ and a gate of the driving transistor M31, and the select signal from the previous scan line $S_{n-1}$ is applied to gates of transistors M33 and M34.

An operation of the pixel circuit according to the fourth exemplary embodiment will now be described in reference to FIG. 10.

When the select signal from the previous scan line $S_{n-1}$ becomes low level, the transistors M33 and M34 are turned on, the power supply voltage $V_{DD}$ is applied to the first electrode A4 of the capacitor $C_{st4}$, and the compensation voltage $V_{sus}$ is applied to the second electrode B4 thereof.

Next, the select signal from the present scan line $S_n$ becomes low level, and the transistor M32 is turned on. Therefore, the voltage of the second electrode B4 of the capacitor $C_{st4}$ is changed to the data voltage, and the voltage of the first electrode A4 of the capacitor $C_{st4}$ is changed by a voltage variation of the second electrode B4 of the capacitor $C_{st4}$. The voltage of the first electrode A4 of the capacitor $C_{st4}$ is given as Equation 11.

$$V_{A4}=V_{DD}+\Delta V_{B4}=V_{DD}+V_{DATA}-V_{sus} \quad \text{Equation 11}$$

Therefore, the power supply voltage $V_{DD}$ and the voltage of the first electrode A4 of the capacitor $C_{st4}$ are applied to both electrodes of the capacitor C2, and the capacitor C2 is charged.

In this instance, the voltage charged in the capacitor C2 is given as Equation 12, and the corresponding current flows to the OLED.

$$V_{C2}=V_{DD}-(V_{DD}+V_{DATA}-V_{sus})=V_{DATA}-V_{sus} \quad \text{Equation 12}$$

The current flowing to the OLED is given as Equation 13.

$$\begin{aligned} I_{OLED} &= \frac{\beta}{2}(V_{GS31}-V_{TH31})^2 \\ &= \frac{\beta}{2}((V_{DATA}-V_{sus})-V_{TH31})^2 \end{aligned} \quad \text{Equation 13}$$

As can be seen from Equation 13, the current flowing to the OLED is substantially not influenced by the power supply voltage $V_{DD}$.

Figure 11:
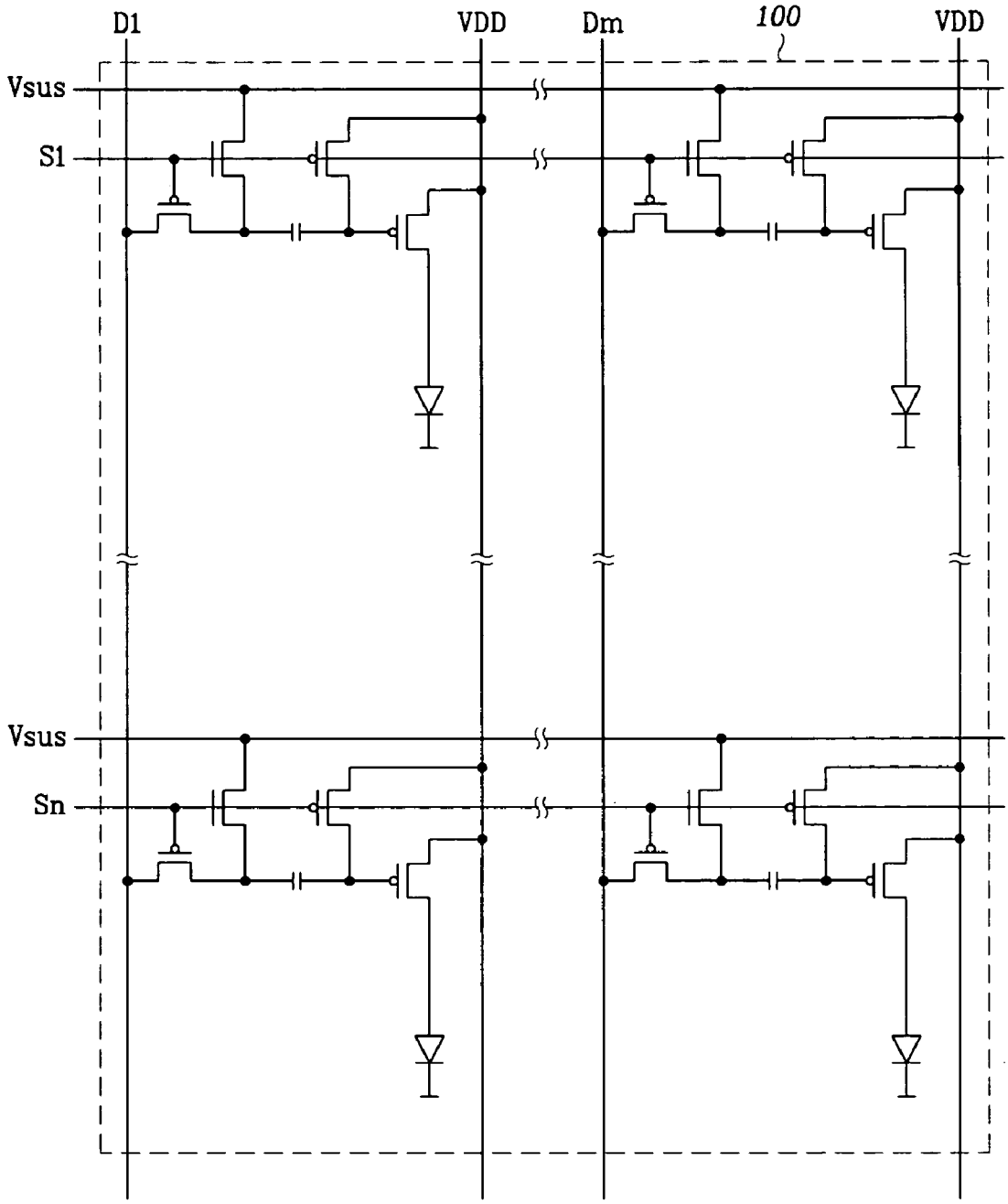
FIG. 11 shows a display panel which incorporates the pixel circuit of FIG. 6A.

FIG. 11 shows a case wherein the pixel circuit of the first exemplary embodiment is applied to a display panel of the light emitting display.

As shown, a plurality of pixel circuits is coupled to a line for supplying the power supply voltage $V_{DD}$. A voltage drop is generated in the display panel 100 because of a parasitic resistance component that exists in the line for supplying the power supply voltage $V_{DD}$. According to the first exemplary embodiment of the present invention, the current flowing to the OLED is substantially not influenced by the voltage drop provided on the above-noted line.

Figure 12:
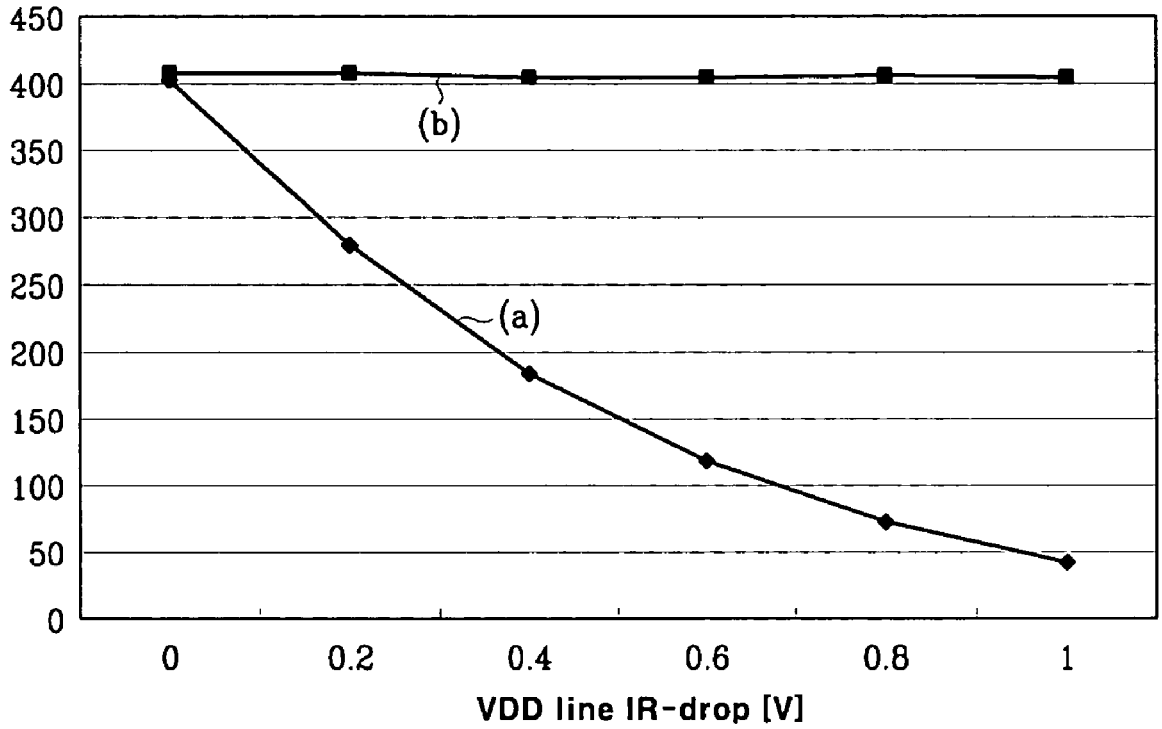
FIG. 12 is a graph that shows a relationship between the current that flows to the OLED and a voltage drop of the power supply voltage in pixel circuits of a light emitting display.

FIG. 12 is a graph that shows a relationship between the current that flows to the OLED and the voltage drop of the power supply voltage $V_{DD}$ in pixel circuits of a light emitting display.

A curve (a) shows a current curve of the conventional pixel circuit, and a curve (b) illustrates a current curve of the pixel circuit according to the first exemplary embodiment of the present invention.

As shown in FIG. 12, the current flowing to the OLED is strongly influenced by the voltage drop of the line in the conventional pixel circuit, and the current is very little influenced by the voltage drop in the pixel circuit according to the first exemplary embodiment of the present invention.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims.

For example, the transistors M1 and M5 of FIG. 6A-6C as well as other transistors in other figures can be realized with the transistors having the N-type channel as well as those of the P-type channel. Further, they may also be implemented with active elements which have first, second, and third electrodes, and control the current that flows to the third electrode from the second electrode by the voltage applied between the first and second electrodes.

Also, the transistors M12, M13, M14, and M16 of FIG. 7A as well as corresponding transistors in other figures, which are elements for switching both electrodes in response to the select signal, may be realized by using various other types of switches that perform substantially the same or similar functions.

A light emitting display suitable for application as a large screen and high brightness display is provided by controlling the current that flows to the OLED to be substantially not influenced by the power supply voltage.

Further, the current flowing to the OLED is more finely controlled by compensating for a deviation of the power supply voltage and/or a deviation of the threshold voltage of the driving transistor.

In addition, the aperture ratio of the light emitting display is enhanced by compensating for a deviation of the power supply voltage and/or a deviation of the threshold voltage of the driving transistor with lesser number of scan lines.

What is claimed is:

1. A light emitting display including a plurality of data lines for transmitting data voltages corresponding to video signals, a plurality of scan lines for transmitting select signals, and a plurality of pixel circuits, each said pixel circuit coupled to a corresponding said data line to receive a corresponding said data voltage and a corresponding said scan line to receive a corresponding said select signal, each said pixel circuit comprising:

a transistor including a first electrode, a second electrode for receiving a first power supply voltage, and a third electrode for outputting a current corresponding to a voltage between the first electrode and the second electrode;

a light emitting element coupled to the third electrode for emitting light corresponding to the current outputted by the third electrode;

a first switch for transmitting the corresponding said data voltage in response to the corresponding said select signal from the corresponding said scan line; and a voltage compensator for receiving the corresponding said data voltage transmitted by the first switch and a second power supply voltage, and for applying a compensated data voltage based on the corresponding said data voltage, the first power supply voltage and the second power supply voltage to the first electrode of the transistor, wherein the voltage compensator comprises:

a capacitor having a first electrode coupled to the first electrode of the transistor, and a second electrode coupled to the first switch;

a second switch for applying the first power supply voltage to the first electrode of the capacitor in response to a first control signal; and a third switch coupled between the second electrode of the capacitor and the second power supply voltage, for substantially electrically isolating the second power supply voltage from the second electrode of the capacitor in response to a second control signal.

2. The light emitting display of claim 1, wherein the first and second switches include transistors having a same channel type, and the first control signal is the corresponding said select signal or another signal which has substantially same characteristics as the corresponding said select signal.

3. The light emitting display of claim 1, wherein the third switch includes a transistor having a channel type which is different from that of the first switch, and the second control signal is the corresponding said select signal or another signal which has substantially same characteristics as the corresponding said select signal.

4. The light emitting display of claim 1, wherein the compensated data voltage is substantially the same as a voltage obtained by subtracting the corresponding said data voltage from a summation of the first and second power supply voltages.

5. A light emitting display including a plurality of data lines for transmitting data voltages corresponding to video signals, a plurality of scan lines for transmitting select signals, and a plurality of pixel circuits, each said pixel circuit coupled to a corresponding said data line to receive a corresponding said data voltage and a corresponding said scan line to receive a corresponding said select signal, each said pixel circuit comprising:

a first transistor including a first electrode, a second electrode for receiving a first power supply voltage, and a third electrode for outputting a current corresponding to a voltage between the first electrode and the second electrode;

a light emitting element coupled to the third electrode for emitting light corresponding to the current outputted by the third electrode;

a second transistor including a first electrode, a second electrode, and a third electrode, the second transistor being diode-connected through electrical coupling of its first and third electrodes, and being configured to compensate for a threshold voltage of the first transistor;

a first switch for transmitting the corresponding said data voltage to the second electrode of the second transistor in response to the corresponding said select signal; and a voltage compensator coupled between the first electrode of the first transistor and the first electrode of the second transistor, for receiving a voltage applied to the first electrode of the second transistor and for applying a compensated data voltage with a value based on said voltage applied to the first electrode of the second transistor and the first power supply voltage to the first electrode of the first transistor.

6. The light emitting display of claim 5, wherein the first and second transistors have substantially same characteristics.

7. The light emitting display of claim 5, wherein the first and second transistors have a P-type channel, the first electrode is a gate electrode, the second electrode is a source electrode, and the third electrode is a drain electrode.

8. The light emitting display of claim 5, wherein the first and second transistors have an N-type channel, the first electrode is a gate electrode, the second electrode is a drain electrode, and the third electrode is a source electrode.

9. A light emitting display including a plurality of data lines for transmitting data voltages corresponding to video signals, a plurality of scan lines for transmitting select signals, and a plurality of pixel circuits, each said pixel circuit coupled to a corresponding said data line to receive a corresponding said data voltage and a corresponding said scan line to receive a corresponding said select signal, each said pixel circuit comprising:

a first transistor including a first electrode, a second electrode for receiving a first power supply voltage, and a third electrode for outputting a current corresponding to a voltage between the first electrode and the second electrode;

a light emitting element coupled to the third electrode for emitting light corresponding to the current outputted by the third electrode;

a second transistor including a first electrode, a second electrode, and a third electrode, the second transistor being diode-connected;

a first switch for transmitting the corresponding said data voltage to the second electrode of the second transistor in response to the corresponding said select signal; and a voltage compensator coupled between the first electrode of the first transistor and the first electrode of the second transistor, for receiving a voltage applied to the first electrode of the second transistor and for applying a compensated data voltage based on said voltage applied to the first electrode of the second transistor and the first power supply voltage to the first electrode of the first transistor, wherein the voltage compensator comprises:

a capacitor having a first electrode coupled to the first electrode of the first transistor, and a second electrode coupled to the first electrode of the second transistor;

a second switch for applying the first power supply voltage to the first electrode of the capacitor in response to a first control signal; and a third switch coupled between the second electrode of the capacitor and a second power supply voltage, for substantially electrically isolating the second electrode of the capacitor from the second power supply voltage in response to a second control signal.

10. The light emitting display of claim 9, wherein the first and second switches include transistors having a same channel type, and the first control signal is the corresponding said select signal or another signal which has substantially same characteristics as the corresponding said select signal.

11. The light emitting display of claim 9, wherein the third switch includes a transistor having a channel type which is different from that of the first switch, and the second control signal is the corresponding said select signal or another signal which has substantially same characteristics as the corresponding said select signal.

12. The light emitting display of claim 9, further comprising a fourth switch for transmitting a pre-charge voltage to the third electrode of the second transistor in response to a third control signal.

13. The light emitting display of claim 12, wherein the third control signal is another said select signal from a previous said scan line applied before the corresponding said select signal is applied.

14. The light emitting display of claim 12, wherein the pre-charge voltage is established to be less than a lowest level of the corresponding said data voltage.

15. A display panel of a light emitting display including a plurality of data lines for transmitting data voltages corresponding to video signals, a plurality of scan lines for transmitting select signals, and a plurality of pixel circuits, each said pixel circuit coupled to a corresponding said data line to receive a corresponding said data voltage and a corresponding said scan line to receive a corresponding said select signal, each said pixel circuit comprising:

a transistor including a first electrode, a second electrode for receiving a first power supply voltage, and a third electrode for outputting a current corresponding to a voltage between the first electrode and the second electrode;

a light emitting element coupled to the third electrode for emitting light corresponding to the current outputted by the third electrode;

a capacitor having a first electrode coupled to the first electrode of the transistor; and a switch for switchably coupling a second electrode of the capacitor and the corresponding said scan line, wherein operating periods of the pixel circuits include:

a first period during which the first power supply voltage is applied to the first electrode of the capacitor while the corresponding said data voltage is concurrently applied to the second electrode of the capacitor, and a second period during which the first electrode of the capacitor is substantially electrically isolated from the first power supply voltage while a second power supply voltage is concurrently applied to the second electrode of the capacitor.

16. The display panel of claim 15, wherein the transistor has a P-type channel, the first electrode is a gate electrode, the second electrode is a source electrode, and the third electrode is a drain electrode.

17. The display panel of claim 15, wherein the transistor has an N-type channel, the first electrode is a gate electrode, the second electrode is a drain electrode, and the third electrode is a source electrode.

18. A display panel of a light emitting display including a plurality of data lines for transmitting data voltages corresponding to video signals, a plurality of scan lines for transmitting select signals, and a plurality of pixel circuits, each said pixel circuit coupled to a corresponding said data line to receive a corresponding said data voltage and a corresponding said scan line to receive a corresponding said select signal, each said pixel circuit comprising:

a first transistor including a first electrode, a second electrode for receiving a first power supply voltage, and a third electrode for outputting a current corresponding to a voltage between the first electrode and the second electrode;

a light emitting element coupled to the third electrode for emitting light corresponding to the current outputted by the third electrode;

a capacitor having a first electrode coupled to the first electrode of the first transistor;

a second transistor including a first electrode coupled to the second electrode of the capacitor, a second electrode, and a third electrode, the second transistor being diode-connected through electrical coupling of its first and third electrodes, and being configured to compensate for a threshold voltage of the first transistor; and a switch for switchably coupling the second electrode of the second transistor and the corresponding said scan line, wherein operating periods of the pixel circuits include:

a first period during which the first power supply voltage is applied to the first electrode of the capacitor while the corresponding said data voltage is concurrently applied to the second electrode of the second transistor, and a second period during which a second power supply voltage is applied to the second electrode of the capacitor.

19. The display panel of claim 18, wherein a pre-charge voltage is applied to the third electrode of the second transistor before the first period.

20. The display panel of claim 19, wherein the pre-charge voltage is established to be less than a lowest level of the corresponding said data voltage.

21. A method for driving a display panel including a matrix of pixel circuits, each said pixel circuit including: a transistor including a first electrode, a second electrode for receiving a first power supply voltage, and a third electrode for outputting a current corresponding to a voltage between the first electrode and the second electrode; a light emitting element coupled to the third electrode for emitting light corresponding to the current outputted by the third electrode; a capacitor having a first electrode coupled to the first electrode of the transistor; and a switch coupled between a second electrode of the capacitor and a scan line, the method comprising:

applying the first power supply voltage to the first electrode of the capacitor while concurrently applying a data voltage to the second electrode of the capacitor through the switch; and substantially electrically isolating the first electrode of the capacitor from the first power supply voltage while concurrently applying a second power supply voltage to the second electrode of the capacitor.

22. The method of claim 21, wherein the transistor has a P-type channel, and the first power supply voltage is a positive voltage.

23. The method of claim 21, wherein the second power supply voltage is less than a summation of the data voltage and a threshold voltage of the transistor.

24. A method for driving a display panel including a matrix of pixel circuits, each said pixel circuit including: a first transistor including a first electrode, a second electrode for receiving a first power supply voltage, and a third electrode for outputting a current corresponding to a voltage between the first electrode and the second electrode; a light emitting element coupled to the third electrode for emitting light corresponding to the current outputted by the third electrode; a capacitor having a first electrode coupled to the first electrode of the first transistor; a second transistor having a first electrode coupled to a second electrode of the capacitor, a second electrode, and a third electrode, the second transistor being diode-connected through electrical coupling of its first and third electrodes; and a switch coupled between the second electrode of the second transistor and a scan line, the method comprising:

applying the first power supply voltage to the first electrode of the capacitor while concurrently applying a data voltage to the second electrode of the second transistor through the switch;

applying a second power supply voltage to the second electrode of the capacitor, and compensating for a threshold voltage of the first transistor via the second transistor.

25. The method of claim 24, wherein the transistors include transistors having a P-type channel, and the first power supply voltage is a positive voltage.

26. The method of claim 24, wherein the second power supply voltage is less than a summation of the data voltage and a threshold voltage of the transistor.

* * * * *